US005580266A

United States Patent [19]

Shelly

[11] Patent Number: 5,580,266

[45] Date of Patent: Dec. 3, 1996

[54] HIGH VOLTAGE LOW CURRENT CONNECTOR INTERFACE

[75] Inventor: Christopher W. Shelly, Hummelstown, Pa.

[73] Assignee: The Whitaker Corporation, Wilmington, Del.

[21] Appl. No.: 402,083

[22] Filed: Mar. 10, 1995

[51] Int. Cl.[6] ..... H01R 13/52

[52] U.S. Cl. ..... 439/281

[58] Field of Search ..... 439/271, 272, 439/278, 281, 282

[56] References Cited

U.S. PATENT DOCUMENTS

| | | | |
|---|---|---|---|
| 3,328,744 | 6/1967 | Fiske | 339/61 |
| 3,402,381 | 9/1968 | Gaw et al. | 339/94 |
| 3,522,575 | 8/1970 | Watson et al. | 339/89 |
| 3,533,047 | 10/1970 | McFarlane | 339/94 |
| 3,747,048 | 7/1973 | Johnson et al. | 339/75 R |
| 3,750,084 | 7/1973 | Gardner | 339/61 R |
| 3,824,526 | 7/1974 | Glover | 339/94 R |
| 3,842,389 | 10/1974 | Glover et al. | 339/60 M |
| 3,842,393 | 10/1974 | Glover et al. | 339/60 M |
| 3,850,495 | 11/1974 | Glover | 339/60 M |
| 3,852,512 | 12/1974 | Herrmann, Jr. | 174/19 |
| 3,871,735 | 3/1975 | Herrmann, Jr. | 339/177 R |
| 3,888,559 | 6/1975 | Geib | 339/46 |
| 3,945,701 | 3/1976 | Boeke et al. | 339/60 R |
| 3,945,708 | 3/1976 | Griffin | 339/189 R |
| 3,963,295 | 6/1976 | Askman et al. | 339/60 R |
| 3,994,553 | 11/1976 | Kornick | 339/60 R |
| 4,090,759 | 5/1978 | Herrmann, Jr. | 339/60 M |
| 4,116,521 | 9/1978 | Herrmann, Jr. | 339/60 R |
| 4,296,986 | 10/1981 | Herrmann, Jr. | 339/89 C |
| 4,417,736 | 11/1983 | Herrmann, Jr. | 277/212 R |
| 4,605,272 | 8/1986 | Myers et al. | 339/60 M |
| 4,684,189 | 8/1987 | Swaffield | 439/587 |
| 4,707,045 | 11/1987 | Ney et al. | 439/588 |
| 4,886,471 | 12/1989 | Fleshman, Jr. | 439/587 |
| 4,904,198 | 2/1990 | Begitschke et al. | 439/281 |
| 4,986,764 | 1/1991 | Eaby et al. | 439/275 |

FOREIGN PATENT DOCUMENTS 1116143 6/1968 United Kingdom .

OTHER PUBLICATIONS

*AMP Catalog 73–218*, "LGH High Voltage Lead Assemblies, Connectors and Receptacles", Revised 2–84; pp. 1–5, 24–29, 55,56; AMP Incorporated, Harrisburg, PA.

*Reynolds Industries Catalog*, "Subminiature High Voltage Connectors & Cable Assemblies", eleven pages; 1986; Reynolds Industries Inc., Freehold, NJ.

International Search Report dated Apr. 10, 1996 in Application No. PCT/US95/16020.

*Primary Examiner*—Neil Abrams
*Assistant Examiner*—Yong Kim
*Attorney, Agent, or Firm*—Anton P. Ness

[57] ABSTRACT

A high voltage electrical connector assembly having a first connector (10) with socket terminals (14) in respective silos gradually tapered (28), matable with a second connector (110) having pin terminals (130) along a mating face (22, 120). A forward housing section (118) of the second connector (110) is of elastomeric material to define sealing of the mating face (22,120) against voltage leakage paths that otherwise would permit generation of corona, upon compressive engagement with rigid material of the first housing (12). Each silo-receiving recess (140) is gradually tapered and contains axially spaced annular embossments (150), with generally the axial location of embossments of some recesses (140A, 140C) being staggered axially with respect to the embossments of adjacent recesses (140B). Each recess bottom (148) includes a forwardly extending flange (154) surrounding the pin contact section (144) to be received in a complementary recess (36) in the silo's leading end (30) and be longitudinally compressed to form a seal (166) against the abutting surfaces of the complementary recess upon full mating, adjacent and along the pin contact section (144).

35 Claims, 6 Drawing Sheets

HIGH VOLTAGE LOW CURRENT CONNECTOR INTERFACE

FIELD OF THE INVENTION

The present invention relates to the field of electrical connectors and more particularly to matable connectors containing pluralities of electrical contacts for high voltage low current interconnections.

BACKGROUND OF THE INVENTION

Electrical connectors are frequently used to provide electrical connection in high voltage, low current energy systems, e.g., in systems carrying about 1000 volts up to about 50 Kv at one-half ampere or less, and the electrical transmission may be continuous or pulsed. Such connectors must operate with high reliability, often under severe environmental conditions. For example, connectors are frequently incorporated into high-voltage, electronic circuits located in hostile environments and must maintain peak performance within a broad temperature range and under diverse vaporous and gaseous conditions. In aircraft, such systems must having high reliability in a temperature range of from −55° C. to +125° C. and from sea level to 70,000 feet altitude, where ambient pressure is substantially lower than at sea level.

The primary problems with such high voltage applications are the discharge of voltage along a path from the connection to the environment, and the formation of corona (or voltage leakage) around the connection; both problems are aggravated under high altitude, extreme temperature conditions. Voltage discharge is a failure of the connector requiring connector replacement. Corona formation and voltage leakage commonly leads to degradation and possible breakdown of the dielectric insulation around the terminals and the conductors of the conductor wires, which commonly leads eventually to voltage discharge. To minimize corona formation and avoid voltage leakage and accompanying dielectric voltage breakdown, it is necessary that an assured airtight dielectric seal established about the terminals in their mated condition, and at the termination of the terminals with their respective conductors.

In prior art connectors for high voltage, resistance to corona formation and resultant voltage discharge is built into the connector housings by careful selection of dielectric materials, housing structure design and assembly of the terminals into the housings. In one typical high voltage connector arrangement, the pin terminal is molded within a multi-terminal receptacle housing which is adapted to be mounted to a bulkhead, and the socket terminal is disposed within a multi-terminal plug housing. The housings are secured together after mating through a conventional coupling ring rotatably mounted on the plug housing and threadedly engageable with the cylindrical housing flange defining a receptacle wall surrounding a respective pin contact section of each pin terminal in the receptacle housing. Conventionally where the terminals are inserted into passageways of a premolded housing, the conductor wires exit from the rearward housing faces and potting material is used to seal the gap between the wire insulation and the housing; the potting material minimizes the possibility of voltage discharge from the rearward face of the connector.

In U.S. Pat. No. 4,386,471, the socket terminal is terminated to a conductor wire and a respective plug housing is molded therearound of silicone rubber, and has a long axial recess extending axially thereinto from the forward face thereof to receive force-fittably thereinto the receptacle wall of the mating receptacle housing so that the silicone rubber plug wall forces practically all air from the cavity and establishes a tight grip along the inside and outside surfaces of the rigid receptacle wall; the tight air-free grip is sufficient to establish assured sealing around the mated contact interface and also adequate resistance to unintentional decoupling without other fastening means but permit intentional decoupling under sufficient axial force.

In a product of AMP Incorporated known as an LGH High Voltage Lead Assembly, Part No. 1-846290-7, a socket terminal terminated onto an insulated length of conductor undergoes an insert molding process to mold therearound a plug housing of silicone rubber such that the housing material is bonded to outer surfaces of the terminal and to an adjacent insulated portion of the conductor. The plug housing is molded to define a gradual taper to its forward end coincident with the socket terminal's forward end. The mating receptacle housing containing the pin terminal is molded of rigid dielectric material to define a cylindrical cavity into which the plug housing is received during connector mating to form a sealed mating interface surrounding the mated terminals.

In U.S. Pat. No. 4,986,764 is disclosed a matable lead assembly for a single transmission circuit, wherein a socket terminal and a pin terminal are disposed within respective cylindrical housings. A silo-shaped receptacle portion around and forwardly of the pin contact section, snugly receives thereinto a forward plug portion of reduced diameter that encases the socket contact section. Spaced apart O-rings are disposed along and tightly around the plug portion, and the O-rings are compressed by the receptacle portion and assuredly seal the annular space therebetween.

It is desired to provide improved high voltage sealing in a matable electrical connector assembly having a plurality of closely spaced mating terminals.

SUMMARY OF THE INVENTION

The electrical connector of the present invention includes a first connector including a housing containing a plurality of socket terminals having socket contact sections exposed along a mating face, and a second connector including a housing containing a like plurality of pin terminals having pin contact sections exposed along its mating face, with the pin contact sections being complementary and electrically engageable with the socket contact sections upon connector mating. The first connector's housing is of substantially rigid dielectric material, with the socket terminals retained within respective passageways therethrough from a wire exit face to a mating face. The second connector's housing includes a rearward housing section of rigid dielectric material including a transverse body section, and a forward housing section of elastomeric material such as silicone rubber affixed forwardly of the rigid housing section and preferably bonded thereto. The elastomeric forward housing defines rearwardly extending projections extending rearwardly through apertures of the transverse body section of the rearward housing to a wire exit face, with a respective pin terminal disposed through the center of each projection. The elastomeric material of the projections is preferably bonded to body portions of the respective pin terminals, with the projections sealed thereagainst and against the aperture side walls of the rearward housing section's transverse body section therearound.

The elastomeric forward housing defines frustoconical recesses forwardly of the projections containing the pin contacts, for receipt thereinto of respective slightly frustoconical elongate silos of the first connector surrounding, holding and protecting the socket contact sections, where the first connector is made of substantially rigid dielectric material. In one aspect of the present invention, the side walls of the recesses include at least one annular embossment, and preferably a plurality of annular embossments spaced therealong, to engage under compression the side walls of the silos upon full entry thereinto upon full connector mating, with the annular embossments expanding around the silos. Preferably some of the recesses have their annular embossments defining a first arrangement axially offset from a second arrangement of annular embossments of others of the recesses that are generally adjacent thereto, such as in a radial sense. With such offset, upon compression of all the annular embossments, the elastomeric material is locally deformed at axially spaced locations from recess to recess, rather than at the same axial locations, thereby distributing the compressive forces more evenly. Without axial staggering of the locations of the annular embossments of adjacent recesses, sealing pressure of the embossments against the side walls of the silos is increased at the point of closest proximity to the adjacent recess. Optimal sealing occurs when the embossments seal uniformly around the silo. Stresses are reduced in the elastomeric material during the mating cycle, as compared to large stresses that would occur with embossments located at the same axial location, thus reducing mating forces and enhancing embossment durability.

In another aspect of the present invention, mating connectors contain at least one mating terminal pair, and one of the connectors provides a portion of elastomeric material extending to a leading end along and only incrementally spaced from a base portion of pin contact section of each at least one pin terminal, at least upon the connectors being mated. The rigid housing of the mating connector provides a portion-receiving recess along the pin contact base portion adapted to receive thereinto the elastomeric portion. The connectors are adapted such that in final stages of connector mating, the recess bottom abuts the leading end of the elastomeric portion and axially compresses the portion such that the portion is deformed outwardly against side walls of the recess to define a discrete terminal site seal adjacent and along at least the pin contact base section of each mated terminal pair.

More specifically, the elastomeric insert includes a short flange of frustoconical shape at the interior end of each recess surrounding the respective pin contact section and protruding forwardly a limited distance from the bottom of the silo-receiving recess; the flange is engageable by the leading end of the respective silo of the first connector at final stages of connector mating, with the silo leading end eventually received around and along the outer surface of the flange into an annular silo-receiving gap therearound, while the flange is received into an enlarged flange-receiving recess of the silo just forwardly of the leading end of the socket contact section. Preferably the flange and the flange-receiving recess are complementarily tapered. The length of the flange is slightly longer than the length of the flange-receiving recess in the leading end of the silo, so that the flange becomes compressed longitudinally upon abutment with the bottom of the flange-receiving recess and radially expanded firmly against the inwardly facing surface of the flange-receiving recess to seal thereagainst. Concurrently, the inner surface of the silo-receiving recess coextends along the flange and is spaced radially therefrom to define a silo-receiving gap. The outer sidewall of the silo-receiving gap is incrementally greater in diameter than the outer diameter of the silo leading end, permitting expression of air away from the flange and the mated contact sections, and along the outer surface of the silo and rearwardly therealong. Preferably the silo leading end is pressed against the silo-receiving recess bottom and travels incrementally further to eliminate an air pocket threat. The air is forced essentially completely away from the pin and socket contact sections during final stages of connector mating, to minimize formation of voltage leakage paths and to inhibit corona formation during high voltage low current transmission.

It is an objective of the present invention to provide a multi-terminal matable electrical connector assembly for high voltage electrical transmission, that minimizes the formation of voltage leakage paths and corona.

It is another objective for such connector to reduce the forces resistant to connector mating by axially staggering the local compression of portions of the elastomeric insert during connector mating, in a relatively densely populated connector interface of closely spaced terminals.

It is yet another objective for such connector to provide for expression of air in a path away from the mating electrical terminals just prior to full connector mating, thus eliminating, or minimizing the amount of, trapped air along the mating interface and also locate any remaining incremental pockets of trapped air farther from the mated electrical terminals.

An embodiment of the present invention will now be described by way of example with reference to the accompanying drawings.

DETAILED DESCRIPTION OF THE PREFERRED EMBODIMENT

Figure 1:
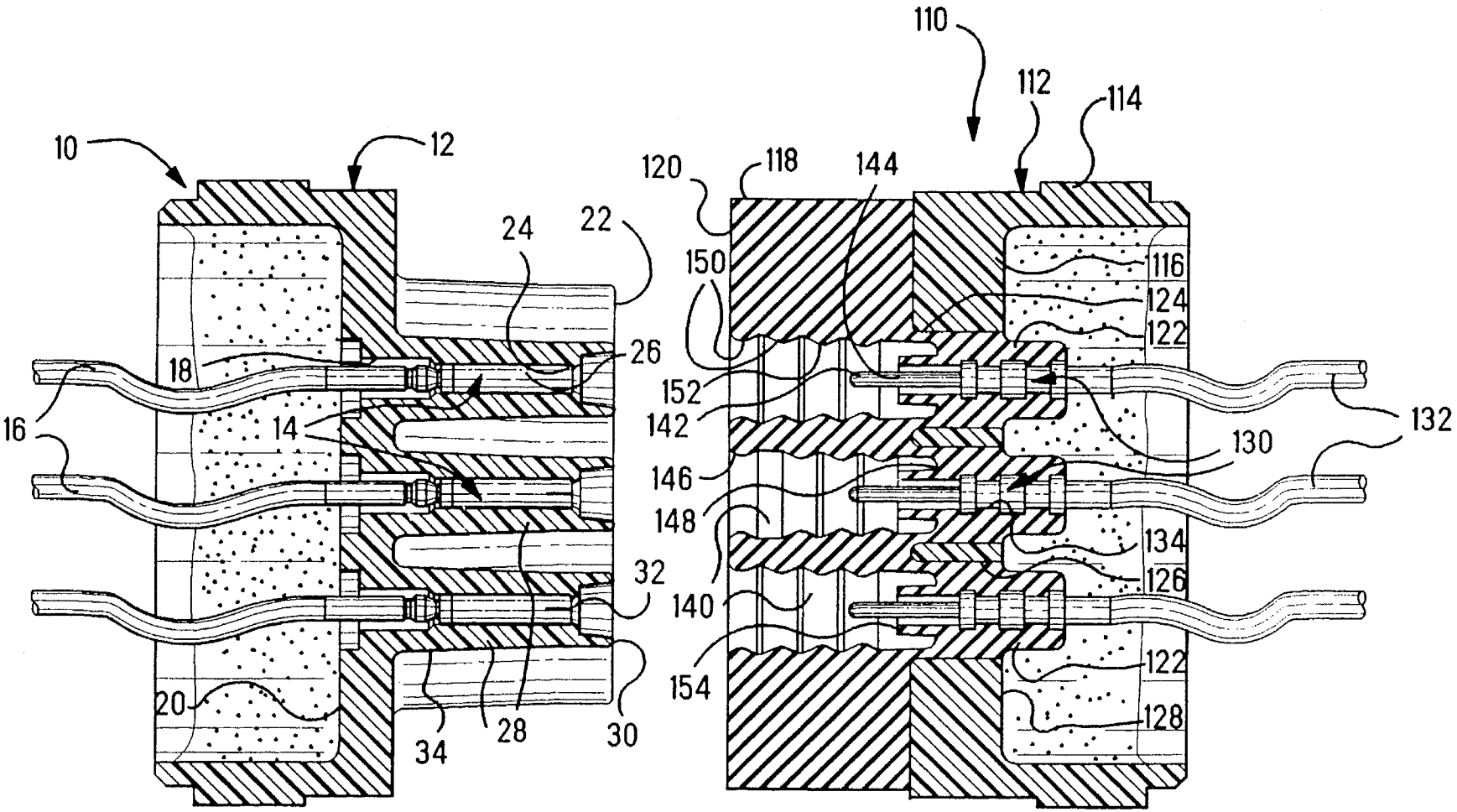
FIG. 1 is a longitudinal section view of the first and second connectors spaced from each other and containing the present inventions.
Figure 3:
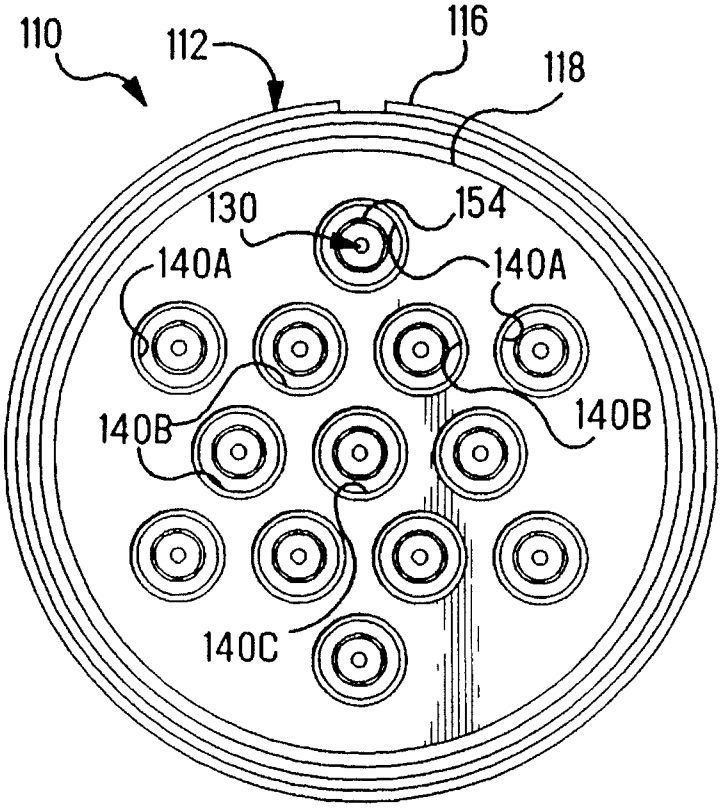
FIGS. 2 and 3 are front elevation views of the first and second connectors of FIG. 1, respectively.
Figure 2:
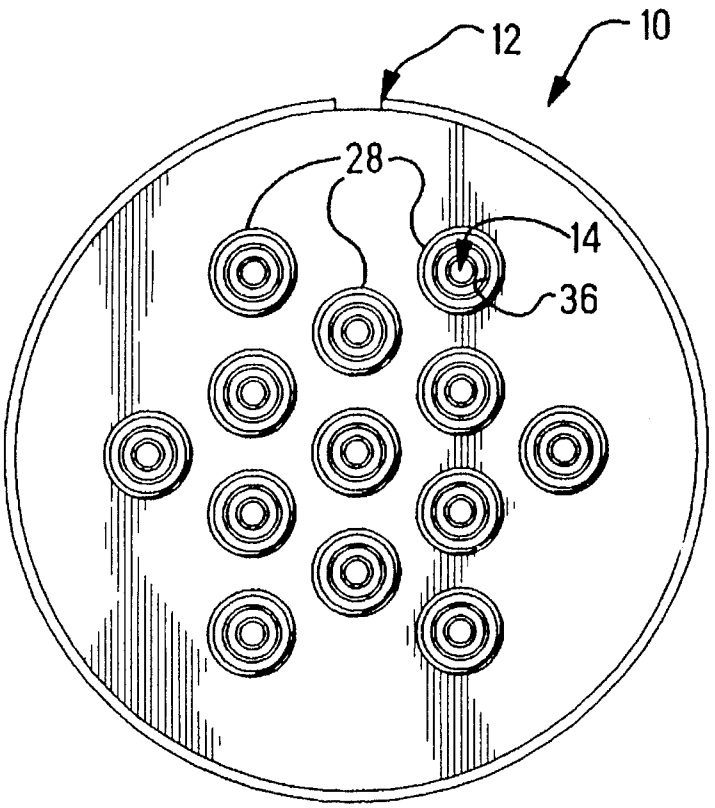

As seen in FIGS. 1 to 3, the matable electrical connector assembly of the present invention comprises a first connector 10 and a second connector 110. First connector 10 has a housing 12 of substantially rigid dielectric material and containing a plurality of socket terminals 14 terminated to respective conductor wires 16 and retained within respective passageways 18 extending from a wire exit face 20 to a mating face 22. Second connector 110 includes a housing 112 having a rearward housing section 114 having a transverse body section 116 of substantially rigid dielectric material, and a forward housing section 118 of elastomeric material affixed to a forwardly facing surface of transverse body section 116 and defining a mating face 120. Commonly the first and second connectors will include protective shells secured therearound (not shown), with the housings comprising inserts secured therein, and with one of the shells including a coupling ring (not shown) for urging the connectors fully together to mate the terminals, as the coupling ring is rotated.

Forward housing section 118 includes a plurality of annular projections 122 extending rearwardly from a rearwardly facing surface of transverse body section 124 thereof and extending through respective apertures 126 through transverse body section 116 to a wire exit face 128. Pin terminals 130 to be terminated to respective conductor wires 132 are disposed within projections 122, in a manner that generates a seal 134 between the elastomeric material of the projections and the body sections of the terminals. Further, projections 122 are also in sealing engagement with side walls of apertures 126, all for effective sealing between wire exit face 128 and mating face 120. Transverse body section 116 of rigid rearward housing section 114 provides support for elastomeric forward housing section 118 and stabilizes the location of the several projections 122 and thus tends to stabilize the location and alignment of pin terminals 130 disposed therethrough. Bonding of the forward housing section with the rearward housing section and with the terminal body sections eliminates air between the elastomeric material the terminals and the rigid dielectric material of the rearward housing section.

Preferably the elastomeric material of the forward housing section is molded to the rearward housing section in a conventional insert molding (or overmolding) process, with previously molded rearward housing section primed and placed into the mold cavity and the terminals also primed and held in position within the mold cavity centered within the apertures through the transverse body section of the rearward housing section for the projections to become formed therearound and bonded thereto, assuring freedom from trapped air in the resulting part; the wire connecting sections of the terminals will extend rearwardly from the wire exit face to permit soldering to wire ends; after soldering the wire ends to the terminals, potting material is preferably deposited into the connector embedding the soldered terminations and the wire end portions. Regarding first connector 10, it is preferred that the body portions of the socket terminals be coated with epoxy to bond with the passageway sidewalls, and the terminals be secured within passageways 18 by force-fit, such as the forward portion of passageways 18 being slightly reduced to be in force-fit engagement with the leading end of the hood portion of the socket terminal surrounding and protecting the spring contact arms of the socket contact section (see FIG. 4); and for potting material to be deposited around the wire exits after termination of the wire ends with the rearward portions of the socket terminals.

Forward housing section 118 further includes a plurality of recesses 140 forwardly of projections 122 and aligned therewith, extending to mating face 120. Leading end portions 142 of pin contact sections 144 extend forwardly into recesses 140 to be exposed for receipt into leading ends 24 of corresponding socket contact sections 26 for mated electrical engagement therewith upon full mating of first and second connectors 10,110.

Figure 4:
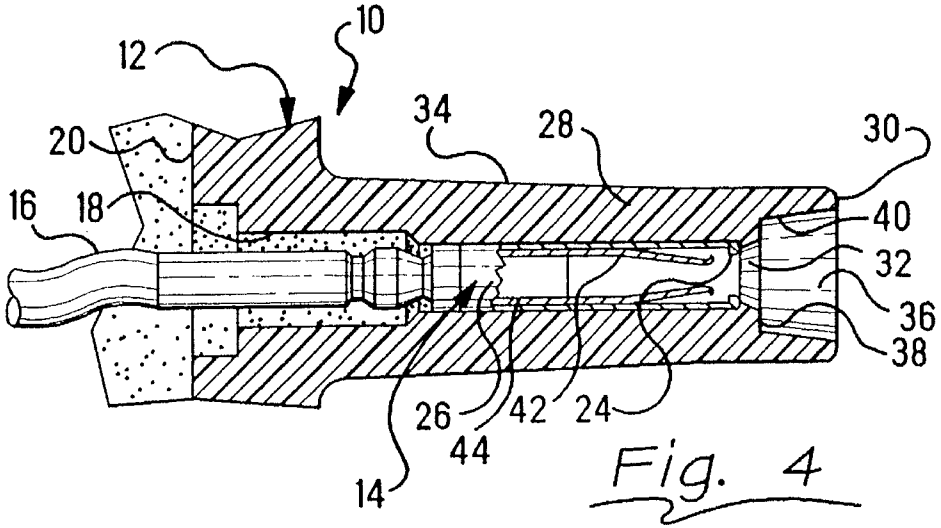
FIGS. 4 and 5 are enlarged partial section views of a socket terminal site of the first connector and a pin contact terminal site of the second connector of FIG. 1, respectively.

Referring to FIGS. 1 and 4, housing 12 of first connector 10 includes a plurality of silos 28 associated with respective socket terminals 14 extending forwardly to silo leading ends 30, with passageways 18 extending forwardly through respective silos 28 to silo leading ends 30. Socket terminals 14 are secured in passageways 18 such as in a force fit, such that leading ends 24 of socket contact sections 26 are recessed from silo leading ends 30, disposed rearwardly of lead-ins 32 that serve to assure centering of the leading end portions 142 of pin contact sections 144 during final stages of connector mating to assure appropriate mating and electrical engagement of the pin and socket terminals. Lead-ins 32 are defined by reduced diameter constrictions having lead-in surfaces angled to face radially inwardly and toward silo leading ends 30 with an innermost dimension grater than the outer dimension of a pin contact section 144.

Figure 5:
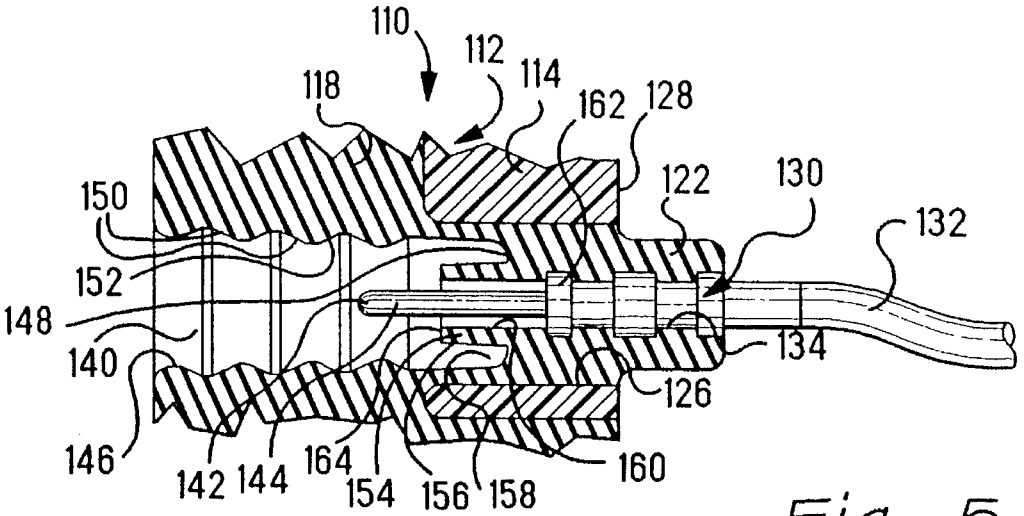

Silos 28 of first connector 10 are slightly or gradually tapered extending to, or almost to, silo leading ends 30, thus defining frustoconical shapes. Referring to FIGS. 1 and 5, recesses 140 of second connector 110 are generally complementarily shaped, being tapered slightly overall from recess entrances 146 at mating face 120 to recess bottoms 148. Each recess 140 also includes at least one annular embossment 150 and preferably several annular embossments 150 about its inner surface 152, spaced axially therealong, each to be eventually engaged by the outer surface 34 of a respective silo 28 upon full mating of the first and second connectors.

Figure 7:
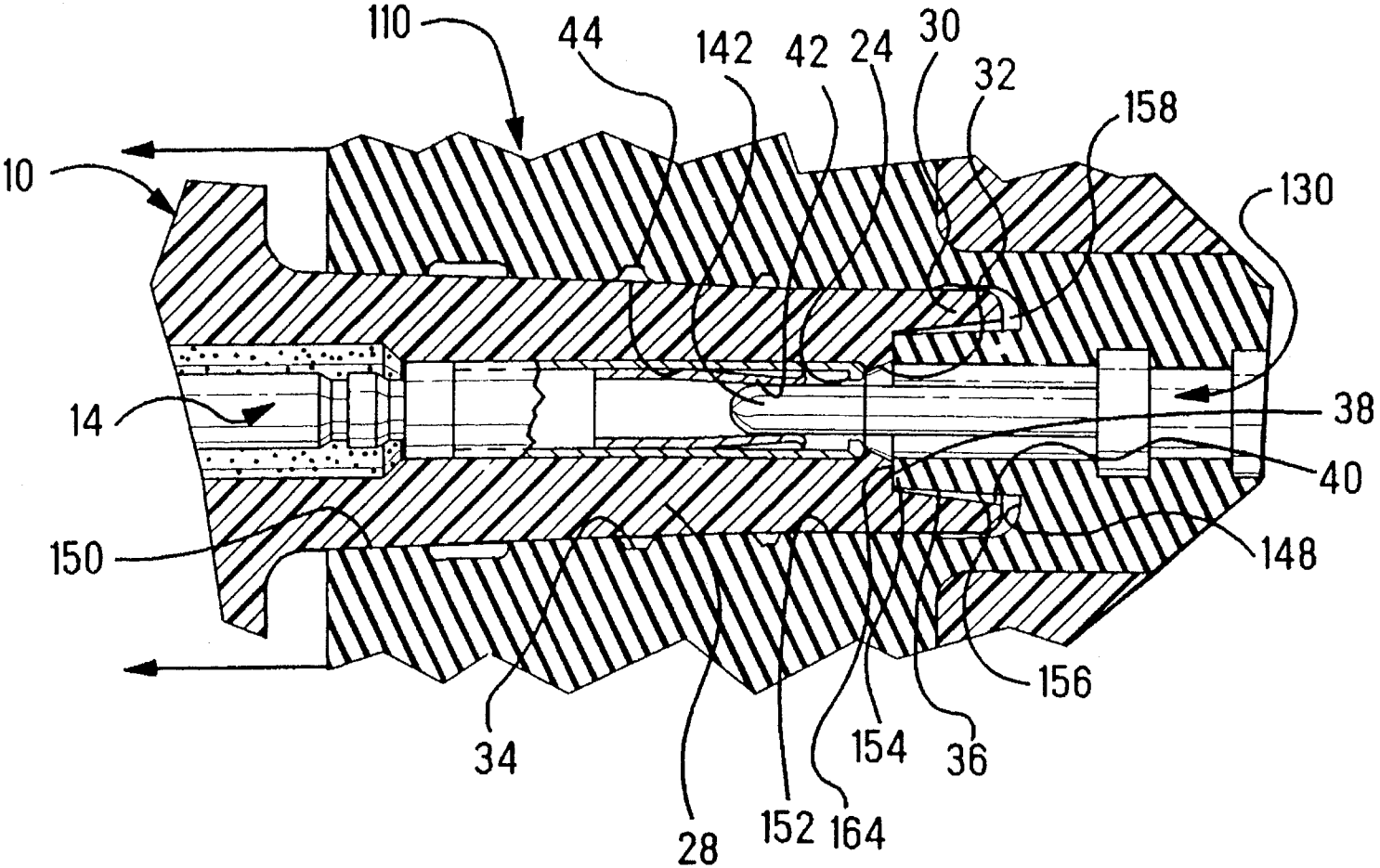

In one aspect of the present invention, generally, adjacent ones of recesses 140 have their annular embossments 150 relatively staggered (except at the recess entrances), all so that the local deformation of the elastomeric material of the forward housing section 118 is distributed axially throughout the material between the plurality of recesses. The staggering of annular embossments may involve selected ones of recesses 140 radially staggered from others thereof. The annular embossments of the radially outermost recesses 140A (referring to FIG. 3) and of the centermost recess 140C may be in a first arrangement of common first axial positions, while the annular embossments of the intermediate circular row of recesses 140B are in a second arrangement of common second axial positions axially offset from the annular embossments of the first arrangement. Thus upon full connector mating (as shown in FIG. 7), all annular embossments 150 are compressed radially outwardly by the outer surfaces 34 of the respective silos 28, and the local deformation of the elastomeric material adjacent the outermost and centermost recesses 140A, 140B is axially offset from the local deformation of the elastomeric material adjacent the intermediate row of recesses 140B.

With such offset, in a multi-terminal high voltage connector where the terminals are relatively closely spaced, upon compression of all the annular embossments, the elastomeric material is locally deformed at axially spaced locations from recess to recess, rather than all at the same axial locations, thereby distributing the compressive forces more evenly. Optimal sealing occurs when each embossment seals uniformly around the silo. Without axial staggering of the locations of the annular embossments of adjacent recesses, sealing pressure of the embossments against the side walls of the silos is increased at the point of closest proximity to the adjacent recess. Stresses are reduced in the elastomeric material during the mating cycle, as compared to large stresses that would occur with embossments located at the same axial location, thus reducing mating forces and enhancing embossment durability.

In another aspect of the present invention, and referring primarily to FIGS. 4 to 8, the silo leading ends 30 and recess bottoms 148 generally define concentrically intermitting pairs of axially extending flanges, with one thereof being of elastomeric material enabling compression for sealing against the surfaces of the rigid material of the other adjacent the terminal sites. A pressure seal is thus formed adjacent and axially coextending along a portion of at least the pin contact section 144. Flange 154 extends forwardly from recess bottom 148, with the inner surface 152 of recess 140 coextending along outer flange surface 156 and spaced radially outwardly therefrom to define a silo-receiving gap 158. Flange 154 is generally concentric around the pin contact section 144 and preferably with an inwardly facing surface 160 spaced radially therefrom a slight distance, forwardly of a forward annular collar 162 of the terminal's body portion. Such flange definition is obtainable in the insert molding process through use of a cylinder. Rial core pin surrounding the pin contact section and abutting the forward annular collar, with the core pin also serving to maintain the pin terminal in position and axially aligned during molding.

A flange-receiving recess 36 is defined into silo leading end 30 forwardly of socket contact section leading end 24 and forwardly of lead-in 32. Gap 158 is adapted to receive thereinto silo leading end 30, while flangereceiving recess 36 receives flange 154 thereinto, upon full mating of the first and second connectors. Preferably both flange 154 and flange-receiving recess 36 have slight complementary tapers. Also, preferably flange 154 is so dimensioned for forwardly facing surface 164 to abut against forwardly facing surface 38 of lead-in 32 prior to full connector mating, and for the elastomeric material of flange 154 to be longitudinally compressed, thereby being radially expanded, or deformed radially outwardly, to establish a pressure engagement between inner surface 40 of flange-receiving recess 36 and outer surface 156 of flange 154. It has been observed that flange 154 does not deform radially inwardly toward the terminal when compressed longitudinally.

Figure 6:
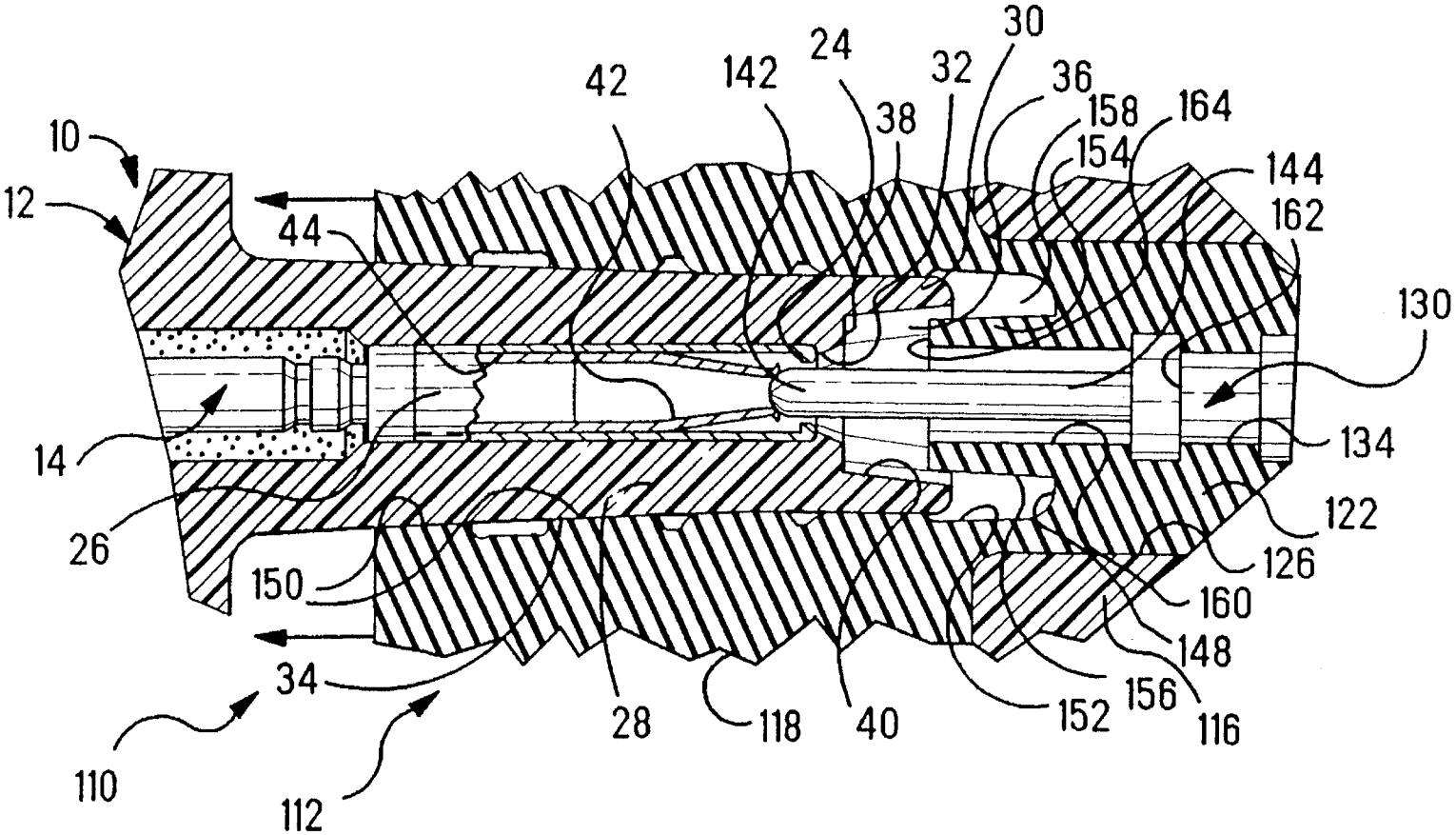
FIGS. 6 to 8 are enlarged section views of the socket and pin terminal sites of FIGS. 4 and 5 during connector mating, with FIG. 6 partially mated, FIG. 7 almost fully mated and FIG. 8 fully mated and the terminal sites sealed.

Referring specifically to FIG. 6, connectors 10,110 are partially mated together. Pin contact section leading end 142 has been received past lead-in 32 (after centering has been assured thereby) and into initial engagement with spring arms 42 within the socket's protective hood 44 and recessed from socket contact section leading end 24. Annular embossments 150 have initially engaged the adjacent portions of outer surface 34 of silo 28 and have become slightly compressed, still permitting air to be urged thereby. Silo leading end 30 has received the forward portion of flange 154 partially into flangereceiving recess 36.

Referring now to FIG. 7, the connectors are now almost fully mated. Silo leading end 30 just about fills gap 158, and forwardly facing surface 164 of flange 154 has abutted lead-in 32 which defines the bottom of the flange-receiving recess. Annular embossments 150 have entered into substantial engagement with silo outer surface 34 and have been compressed radially outwardly thereby.

Figure 8:
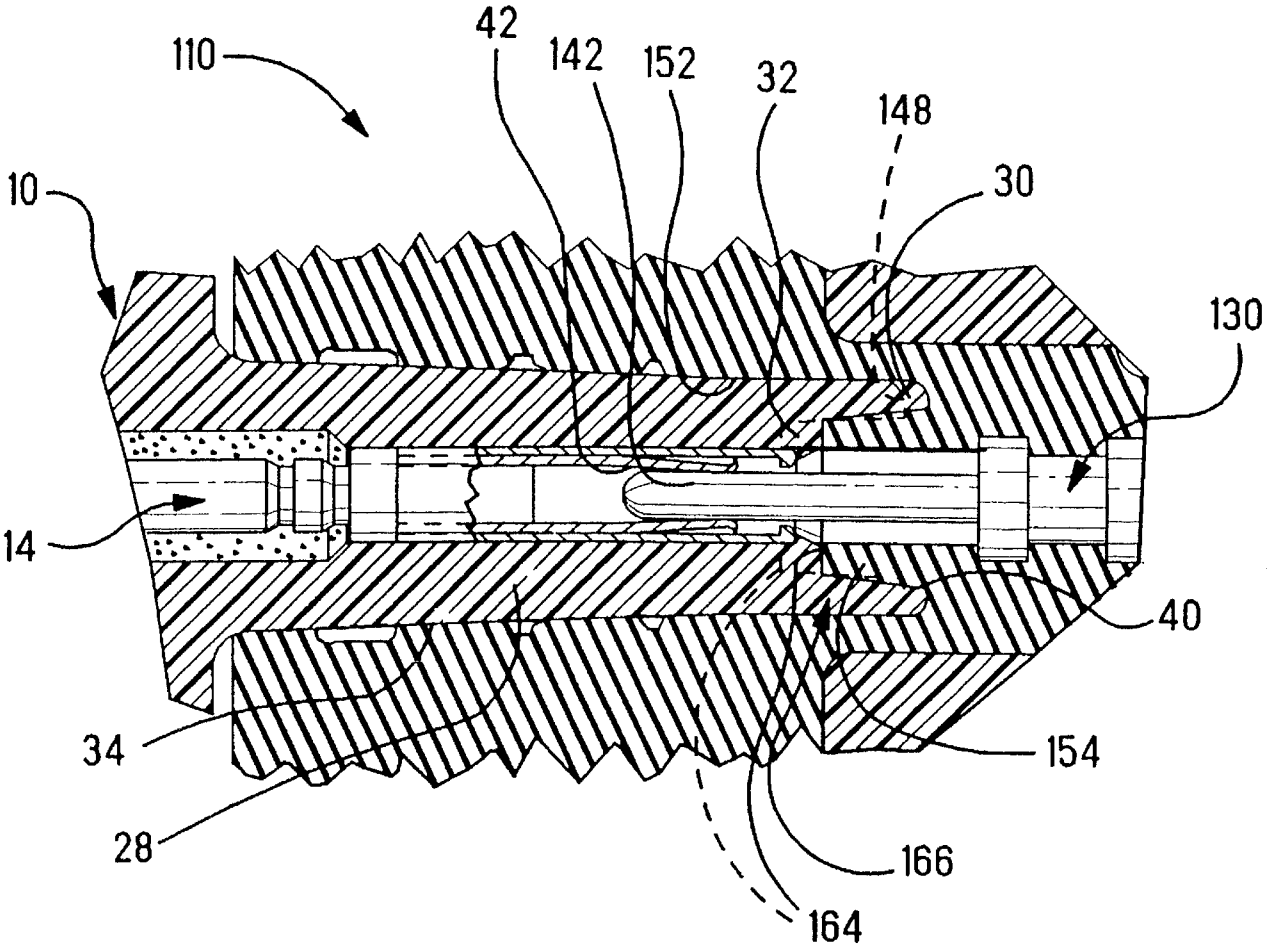

In FIG. 8, the connectors are fully mated. Silo leading end 30 has been urged against recess bottom 148 (now shown in phantom) and pressed into the elastomeric material threat. Flange 154 has been longitudinally compressed to become deformed or expanded radially outwardly tightly against inner recess surface 40 to define pressure seal 166 along a noticeable axial length adjacent the site of the mated electrical contacts 14, 130. Air still trapped along pin contact section 144 within flange 154 is believed to provide pressure outwardly on flange 154 tending to enhance the compressive forces of pressure seal 166. For purposes of comparison, the original length of flange 154 is shown in phantom extending to forwardly facing surface 164. Annular embossments 150 have become greatly compressed to define a plurality of pressure seals axially along silo 28.

In the connector mating sequence depicted in FIGS. 6 to 8, the gradual progression from slight to substantial compression of the annular embossments permits expression of air therepast and outwardly from the mating interface during connector mating, as silo 28 is received progressively deeper into silo-receiving recess 140. Incremental pockets of air eventually remain trapped between the annular embossments and are shown exaggerated in FIGS. 6 to 8 for purposes of explanation, with the nominal inner diameter of the silo-receiving recesses preferably being incrementally larger than the outer diameter of the silos at any given axial location, to minimize difficulty in achieving full connector mating; the incremental amounts of air trapped between the strong pressure seals completely around the silos at the annular embossments are essentially innocuous. Pressure seal 166 and the strong pressure seals defined by greatly compressed annular embossments 150 provide an effectively sealed connector mating interface minimizing the existence of a possible voltage leakage path threat.

Preferably the elastomeric material used for forward housing member 118 is a silicone rubber, such as SILASTIC 55U high tensile strength silicone rubber sold by The Dow Corning Company of Plymouth, Mich. Dielectric material for housing 12 and rearward housing member 114 may be VECTRA A130 glass fiber reinforced copolyester liquid crystal polymer sold by Hoechst-Celanese of Chatham, N.J. The angle of taper of the silo is about 1.75°, and the complementary silo-receiving recess is preferably about 2.12°. The angle of taper of the flange is about 2.86° and that of the sidewalls of the flangereceiving recess is preferably about 6.71°. Also, preferably the distance traveled by the silo leading end beyond the nominal recess bottom is about 0.015 inches. The silo leading end may have an outer surface peripherally therearound that is tapered only sufficiently to facilitate withdrawal from the mold cavity upon molding, for an axial distance of about 0.126 inches. Flange height preferably is about 0.087 inches and the depth of the flange-receiving recess about 0.067 inches.

It can be seen that the number of annular embossments may be varied from the several shown. Further axial staggering of the annular embossments may be accomplished. A pressure seal could also be formed with modified intermitting flanges to coextend along a portion of the socket contact section, such as where the elastomeric member defines a flange-receiving recess receiving a flange of the silo therewithin and is incrementally expanded thereby upon full connector mating.

Other variations and modifications may be adopted that are within the spirit of the invention and the scope of the claims.

What is claimed is:

1. An electrical connector assembly suitable for high voltage low current transmission, comprising:

a first connector including a housing of rigid dielectric material, said housing including passageways extending therethrough from a wire exit face to a first mating face, and said first connector including socket terminals terminated to respective conductor wires disposed within respective said passageways of said housing with socket contact sections disposed within respective forwardly-extending silos to socket contact leading ends recessed within leading ends of said silos;

a second connector including a housing at least including a forward housing section of elastomeric material, said forward housing section including pin terminals terminated to respective conductor wires and disposed therethrough extending from a wire exit face to a second mating face, said pin terminals including pin contact sections complementary with and matable with respective said socket contact sections upon connector mating, and said forward housing section including silo-receiving recesses extending rearwardly from said mating face complementary with respective said silos;

each said silo defining an outer surface and each said silo-receiving recess defining an inner surface dimensioned for sealing engagement therewith upon full connector mating, and said inner surface of each said silo-receiving recess has a gradual taper and said outer surface of each said silo has a complementary taper; and selected ones of said silo-receiving recesses each including at least one annular embossment along said inner surface thereof, said annular embossments of said selected ones of said recesses being all at a common first axial location defining a first arrangement, and selected others of said silo-receiving recesses generally alternating with said selected ones thereof across said second mating face and each including at least one annular embossment along said inner surface thereof, said annular embossments of said selected others of said recesses being all at a common second axial location defining a second arrangement axially staggered from said first arrangement, whereby said annular embossments of said first arrangement deform at an axial location staggered from said annular embossments of said second arrangement, and when the locations of said selected ones and said selected others of said silo-receiving recesses are closely spaced across said second mating face, deformation of said elastomeric material of said forward housing section is more evenly distributed for improved sealing of the mating interface of the connectors upon full mating thereof.

2. A high voltage connector assembly as set forth in claim 1 wherein said housing of said second connector includes a rearward housing section of rigid dielectric material having a transverse body section adjacent and rearwardly of a transverse body section of said forward housing section, and said forward housing section includes a plurality of projections surrounding respective said pin terminals therethrough, with said projections extending rearwardly through respective apertures of said transverse body section of said rearward housing section and sealingly engaged with said apertures and with respective said pin terminals.

3. A high voltage connector assembly as set forth in claim 1 wherein said selected ones of said silo-receiving recesses are radially staggered from said selected others thereof.

4. A high voltage connector assembly as set forth in claim 1 wherein each of said selected ones of said silo-receiving recesses includes a plurality of said annular embossments at respective common axial locations of said first arrangement, and each of said selected others of said silo-receiving recesses includes a plurality of said annular embossments at respective common axial locations of said second arrangement, and said axial locations of said second arrangement are axially staggered from said axial locations of said first arrangement.

5. A high voltage connector assembly as set forth in claim 1 wherein each said silo includes a reduced diameter constriction defining a lead-in along said passageway therethrough proximate said silo leading end just forwardly of said socket contact leading end, and having a lead-in surface with an inner dimension greater than an outer dimension of a said pin contact section for assuring the centering of a respective said pin contact leading end prior to electrical engagement with said socket contact section.

6. A high voltage connector assembly as set forth in claim 1 wherein each said silo-receiving recess of said forward housing section of said second connector includes a flange extending forwardly from a recess bottom thereof, said flange having an outwardly facing surface radially spaced inwardly from a coextending portion of said inside surface of said recess to define a gap therebetween, said flange having an inwardly facing surface at least not bonded to said pin contact section therewithin, and each said silo of said first connector includes a flange-receiving recess into said leading end thereof complementary with a respective said flange to receive thereinto said flange upon full connector mating and be in compressive engagement therewith upon engagement of an inner surface of said flange-receiving recess with an outer surface of said flange, defining a seal adjacent and axially coextending along a portion of at least said pin contact section.

7. A high voltage connector assembly as set forth in claim 6 wherein each said silo includes a lead-in along said passageway therethrough proximate said silo leading end just forwardly of said socket contact leading end, and having an inner dimension less than said passageway and greater than an outer dimension of a said pin contact section for centering a respective said pin contact leading end prior to electrical engagement with said socket contact section, and said flange-receiving recess is disposed between said silo leading end and said lead-in.

8. A high voltage connector assembly as set forth in claim 6 wherein said inner surface of each said flange-receiving recess has a gradual taper and said outer surface of each said flange has a complementary taper.

9. An electrical connector assembly suitable for high voltage low current transmission, comprising:

a first connector including a housing of rigid dielectric material, said housing including passageways extending therethrough from a wire exit face to a first mating face, and said first connector adapted to receive and retain therein a plurality of socket terminals terminated to respective conductor wires to be disposed within respective said passageways of said housing with socket contact sections to be disposed within respective forwardly-extending silos to socket contact leading ends recessed within leading ends of said silos;

a second connector including a housing at least including a forward housing section of elastomeric material, said forward housing section including a corresponding plurality oil pin terminals terminable to respective conductor wires, disposed therethrough extending from a wire exit face to a second mating face, said pin terminals to be of the type including pin contact sections complementary with and matable with respective said socket contact sections upon connector mating, and said forward housing section including silo-receiving recesses extending rearwardly from said mating face complementary with respective said silos;

each said silo defining an outer surface and each said silo-receiving recess defining an inner surface dimensioned for sealing engagement therewith upon full connector mating, and said inner surface of each said silo-receiving recess has a gradual taper and said outer surface of each said silo has a complementary taper; and selected ones of said silo-receiving recesses each including at least one annular embossment along said inner surface thereof, said annular embossments of said selected ones of said recesses being all at a common first axial location defining a first arrangement, and selected others of said silo-receiving recesses generally alternating with said selected ones thereof across said second mating face and each including at least one annular embossment along said inner surface thereof, said annular embossments of said selected others of said recesses being all at a common second axial location defining a second arrangement axially staggered from said first arrangement, whereby said annular embossments of said first arrangement deform at an axial location staggered from said annular embossments of said second arrangement, and when the locations of said selected ones and said selected others of said silo-receiving recesses are closely spaced across said second mating face, deformation of said elastomeric material of said forward housing section is more evenly distributed for improved sealing of the mating interface of the connectors upon full mating thereof.

10. A high voltage connector assembly as set forth in claim 9 wherein said housing of said second connector includes a rearward housing section of rigid dielectric material having a transverse body section adjacent and rearwardly of a transverse body section of said forward housing section, and said forward housing section includes a plurality of projections surrounding respective said pin terminals therethrough, with said projections extending rearwardly through respective apertures of said transverse body section of said rearward housing section and sealingly engaged with said apertures and with respective said pin terminals.

11. A high voltage connector assembly as set forth in claim 9 wherein said selected ones of said silo-receiving recesses are radially staggered from said selected others thereof.

12. A high voltage connector assembly as set forth in claim 9 wherein each of said selected ones of said silo-receiving recesses includes a plurality of said annular embossments at respective common axial locations of said first arrangement, and each of said selected others of said silo-receiving recesses includes a plurality of said annular embossments at respective common axial locations of said second arrangement, and said axial locations of said second arrangement are axially staggered from said axial locations of said first arrangement.

13. An electrical connector assembly suitable for high voltage low current transmission, comprising:

a first connector including a housing of rigid dielectric material, said housing including passageways extending therethrough from a wire exit face to a first mating face, and said first connector including socket terminals terminated to respective conductor wires disposed within respective said passageways of said housing with socket contact sections disposed within respective forwardly-extending silos to socket contact leading ends recessed within leading ends of said silos;

a second connector including a housing at least including a forward housing section of elastomeric material, said forward housing section including pin terminals terminated to respective conductor wires, disposed therethrough extending from a wire exit face to a second mating face, said pin terminals including pin contact sections complementary with and matable with respective said socket contact sections upon connector mating, and said forward housing section including silo-receiving recesses extending rearwardly from said mating face complementary with respective said silos;

each said silo defining an outer surface and each said silo-receiving recess defining an inner surface dimensioned for sealing engagement therewith upon full connector mating; and each said silo-receiving recess of said forward housing section of said second connector includes a flange extending forwardly from a recess bottom thereof, said flange having an outwardly facing surface radially spaced inwardly from a coextending portion of said inside surface of said recess to define a gap therebetween, said flange having an inwardly facing surface at least not bonded to said pin contact section therewithin, and each said silo of said first connector includes a flange-receiving recess into said leading end thereof complementary with a respective said flange to receive thereinto said flange upon full connector mating for engagement between the outer surface of said flange and an inner surface of said flange-receiving recess under pressure at least upon full receipt into said flange-receiving recess defining a seal adjacent and axially coextending along a portion of at least said pin contact section.

14. A high voltage connector assembly as set forth in claim 13 wherein said housing of said second connector includes a rearward housing section of rigid dielectric material having a transverse body section adjacent and rearwardly of a transverse body section of said forward housing section, and said forward housing section includes a plurality of projections surrounding respective said pin terminals therethrough, with said projections extending rearwardly through respective apertures of said transverse body section of said rearward housing section and sealingly engaged with said apertures and with respective said pin terminals.

15. A high voltage connector assembly as set forth in claim 13 wherein said inner surface of each said flange-receiving recess has a gradual taper and said outer surface of each said flange has a complementary taper.

16. A high voltage connector assembly as set forth in claim 13 wherein each said silo includes a reduced diameter constriction defining a lead-in along said passageway therethrough proximate said leading end thereof just forwardly of said socket contact leading end, and having a lead-in surface with an inner dimension greater than an outer dimension of a said pin contact section for assuring the centering of a respective said pin contact leading end prior to electrical engagement with said socket contact section, and said flange-receiving recess is disposed between said silo leading end and said lead-in.

17. A high voltage connector assembly as set forth in claim 16 wherein said inner surface of each said flange-receiving recess has a gradual taper and said outer surface of each said flange has a complementary taper.

18. A high voltage connector assembly as set forth in claim 16 wherein each said flange is dimensioned to abut a forwardly facing surface of said lead-in for the elastomeric material thereof to be longitudinally compressed and be radially expanded outwardly against said inner surface of said flange-receiving recess to establish said pressure engagement.

19. A high voltage connector assembly as set forth in claim 18 wherein said inner surface of each said flange-receiving recess has a gradual taper and said outer surface of each said flange has a complementary taper.

20. A high voltage connector assembly as set forth in claim 13 wherein selected ones of said silo-receiving recesses each including at least one annular embossment along said inner surface thereof, said annular embossments of said selected ones of said recesses being all at a common first axial location defining a first arrangement, and selected others of said silo-receiving recesses generally alternating with said selected ones thereof across said second mating face and each including at least one annular embossment along said inner surface thereof, said annular embossments of said selected others of said recesses being all at a common second axial location defining a second arrangement axially staggered from said first arrangement, whereby said annular embossments of said first arrangement deform at an axial location staggered from said annular embossments of said second arrangement, and when the locations of said selected ones and said selected others of said silo-receiving recesses are closely spaced across said second mating face, deformation of said elastomeric material of said forward housing section is more evenly distributed for improved sealing of the mating interface of the connectors upon full mating thereof.

21. A high voltage connector assembly as set forth in claim 20 wherein said selected ones of said silo-receiving recesses are radially staggered from said selected others thereof.

22. A high voltage connector assembly as set forth in claim 21 wherein each of said selected ones of said silo-receiving recesses includes a plurality of said annular embossments at respective common axial locations of said first arrangement, and each of said selected others of said silo-receiving recesses includes a plurality of said annular embossments at respective common axial locations of said second arrangement, and said axial locations of said second arrangement are axially staggered from said axial locations of said first arrangement.

23. A high voltage connector assembly as set forth in claim 22 wherein said annular embossments are dimensioned to remain at most only slightly engaged with and compressed by said outer surfaces of respective said silos until said flanges are substantially received into and longitudinally compressed within respective said flange-receiving recesses at final stages of connector mating, facilitating expression of air from the mating interface.

24. An electrical connector assembly suitable for high voltage low current transmission, comprising:

a first connector including a housing of rigid dielectric material, said housing including passageways extending therethrough from a wire exit face to a first mating face, and said first connector adapted to receive and retain therein a plurality of socket terminals terminated to respective conductor wires to be disposed within respective said passageways of said housing with socket contact sections to be disposed within respective forwardly-extending silos to socket contact leading ends recessed within leading ends of said silos;

a second connector including a housing at least including a forward housing section of elastomeric material, said forward housing section including a corresponding plurality of pin terminals terminable to respective conductor wires, disposed therethrough extending from a wire exit face to a second mating face, said pin terminals to be of the type including pin contact sections complementary with and matable with respective said socket contact sections upon connector mating, and said forward housing section including silo-receiving recesses extending rearwardly from said mating face complementary with respective said silos;

each said silo defining an outer surface and each said silo-receiving recess defining an inner surface dimensioned for sealing engagement therewith upon full connector mating; and each said silo-receiving recess of said forward housing section of said second connector includes a flange extending forwardly from a recess bottom thereof, said flange having an outwardly facing surface radially spaced inwardly from a coextending portion of said inside surface of said recess to define a gap therebetween, said flange having an inwardly facing surface at least not bonded to said pin contact section therewithin, and each said silo of said first connector includes a flange-receiving recess into said leading end thereof complementary with a respective said flange to receive thereinto said flange upon full connector mating for engagement between the outer surface of said flange and an inner surface of said flange-receiving recess under pressure at least upon full receipt into said flange-receiving recess defining a seal adjacent and axially coextending along a portion of at least said pin contact section.

25. A high voltage connector assembly as set forth in claim 24 wherein said housing of said second connector includes a rearward housing section of rigid dielectric material having a transverse body section adjacent and rearwardly of a transverse body section of said forward housing section, and said forward housing section includes a plurality of projections surrounding respective said pin terminals therethrough, with said projections extending rearwardly through respective apertures of said transverse body section of said rearward housing section and sealingly engaged with said apertures and with respective said pin terminals.

26. A high voltage connector assembly as set forth in claim 24 wherein said inner surface of each said flange-receiving recess. Has a gradual taper and said outer surface of each said flange has a complementary taper.

27. A high voltage connector assembly as set forth in claim 24 wherein each said silo includes a reduced diameter constriction defining a lead-in along said passageway therethrough proximate said leading end thereof just forwardly of said socket contact leading end, and having a lead-in surface with an inner dimension greater than an outer dimension of a said pin contact section for assuring the centering of a respective said pin contact leading end prior to electrical engagement with said socket contact section, and said flange-receiving recess is disposed between said silo leading end and said lead-in.

28. A high voltage connector assembly as set forth in claim 27 wherein said inner surface of each said flange-receiving recess has a gradual taper and said outer surface of each said flange has a complementary taper.

29. A high voltage connector assembly as set forth in claim 27 wherein each said flange is dimensioned to abut a forwardly facing surface of said lead-in prior to full connector mating, for the elastomeric material thereof to be longitudinally compressed and be radially expanded outwardly against said inner surface of said flange-receiving recess to establish said pressure engagement.

30. A high voltage connector assembly as set forth in claim 29 wherein said inner surface of each said flange-receiving recess has a gradual taper and said outer surface of each said flange has a complementary taper.

31. A high voltage connector assembly as set forth in claim 24 wherein selected ones of said silo-receiving recesses each including at least one annular embossment along said inner surface thereof, said annular embossments of said selected ones of said recesses being all at a common first axial location defining a first arrangement, and selected others of said silo-receiving recesses generally alternating with said selected ones thereof across said second mating face and each including at least one annular embossment along said inner surface thereof, said annular embossments of said selected others of said recesses being all at a common second axial location defining a second arrangement axially staggered from said first arrangement, whereby said annular embossments of said first arrangement deform at an axial location staggered from said annular embossments of said second arrangement, and when the locations of said selected ones and said selected others of said silo-receiving recesses are closely spaced across said second mating face, deformation of said elastomeric material of said forward housing section is more evenly distributed for improved sealing of the mating interface of the connectors upon full mating thereof.

32. A high voltage connector assembly as set forth in claim 31 wherein said selected ones of said silo-receiving recesses are radially staggered from said selected others thereof.

33. A high voltage connector assembly as set forth in claim 32 wherein each of said selected ones of said silo-receiving recesses includes a plurality of said annular embossments at respective common axial locations of said first arrangement, and each of said selected others of said silo-receiving recesses includes a plurality of said annular embossments at respective common axial locations of said second arrangement, and said axial locations of said second arrangement are axially staggered from said axial locations of said first arrangement.

34. A high voltage connector assembly as set forth in claim 33 wherein said annular embossments are dimensioned to remain at most only slightly engaged with and compressed by said outer surfaces of respective said silos until said flanges are substantially received into and longitudinally compressed within respective said flange-receiving recesses at final stages of connector mating, facilitating expression of air from the mating interface.

35. An electrical connector assembly suitable for high voltage low current transmissions of the type wherein a first connector includes a housing of rigid dielectric material having a first mating faces said rigid housing including at least one first terminal disposed therethrough extending to a first contact section exposed along said first mating face for electrical engagements a second connector includes a housing including at least one second terminal disposed therethrough extending to a second contact section exposed along a second mating face for electrical engagement, and further including a forward section of elastomeric material along each said second contact section and there beyond, and ones of said first and second contact sections being pin contact sections and others thereof being socket contact sections complementary with and matable with respective said pin contact sections upon connector mating, characterized in that:

said elastomeric forward section provides a portion of elastomeric material extending to a leading end along and only incrementally spaced from a base portion of each said at least one pin contact section at least upon connector mating, and said rigid housing providing a portion-receiving recess along each said pin contact base portion at least upon connector mating, adapted to receive thereinto said portion of elastomeric material during connector mating and further providing a recess bottom associated with said portion leading end; and said connectors are adapted such that in final stages of connector mating said recess bottom engages said portion leading end just prior to full mating, and thereafter axially compresses said portion such that said portion is deformed outwardly against side walls of said portion-receiving recess to define a discrete terminal site seal adjacent and along at least said pin contact base section of each mated terminal pair.

* * * * *